US006073591A

United States Patent [19]

Theriault

[11] Patent Number: 6,073,591

[45] Date of Patent: Jun. 13, 2000

[54] APPARATUS AND METHOD FOR FLUSHING BOILER LOW-WATER CUTOFF SYSTEMS

[76] Inventor: Levi Theriault, 629 N. River Rd., Manchester, N.H. 03104

[21] Appl. No.: 09/138,790

[22] Filed: Aug. 24, 1998

[51] Int. Cl.[7] ..... F22B 37/18

[52] U.S. Cl. ..... 122/379; 122/405

[58] Field of Search ..... 122/379, 380, 122/382, 388, 396, 397, 398, 399, 402, 405; 392/449, 451, 454; 126/344, 362, 361; 137/240, 428, 861, 884

[56] References Cited

U.S. PATENT DOCUMENTS

| | | | |
|---|---|---|---|
| 1,543,614 | 6/1925 | Pence | 137/861 |
| 2,575,240 | 11/1951 | Thompson . | |
| 3,365,567 | 1/1968 | Smith et al. . | |
| 3,530,897 | 10/1968 | Buchanan | 137/637 |
| 4,941,435 | 6/1990 | Person . | |
| 5,060,560 | 1/1990 | VanDeMark . | |
| 5,224,445 | 9/1991 | Gilbert . | |
| 5,479,955 | 1/1996 | Roodvoets et al. | 137/15 |
| 5,603,432 | 2/1997 | Sardynski et al. | 222/129.1 |
| 5,642,756 | 7/1997 | Lawrence et al. | 137/884 |
| 5,722,458 | 3/1998 | Potter | 137/625.47 |

*Primary Examiner*—Denise L. Ferensic
*Assistant Examiner*—Jiping Lu
*Attorney, Agent, or Firm*—Robert R. Deleault, Esq.; Mesmer Law Offices, P.A.

[57] ABSTRACT

A system for preventing boiler low-water failures, caused by obstruction of the working components of low-water cutoff system, which includes a flushing unit attachment. The flushing unit attaches to the boiler low-water cutoff system in place of a manual blowdown unit. The boiler water make-up line is rerouted through the flushing unit, which is in fluid connection with the low-water cutoff system. When the low-water cutoff system detects a low-water level in the boiler it signals the water make-up line to add make-up water to the boiler. The make-up water is routed through the flushing unit, thereby creating a transverse flow of water in the flushing unit. The transverse flow created by the make-up water flushes rust, scale and other debris from the low-water cutoff system and out of the flushing unit. A discharge water line carries the rust, scale and other debris into the boiler. The manual blowdown unit may be reattached below the flushing unit to allow for periodic manual flushing of the low-water cutoff system.

16 Claims, 4 Drawing Sheets

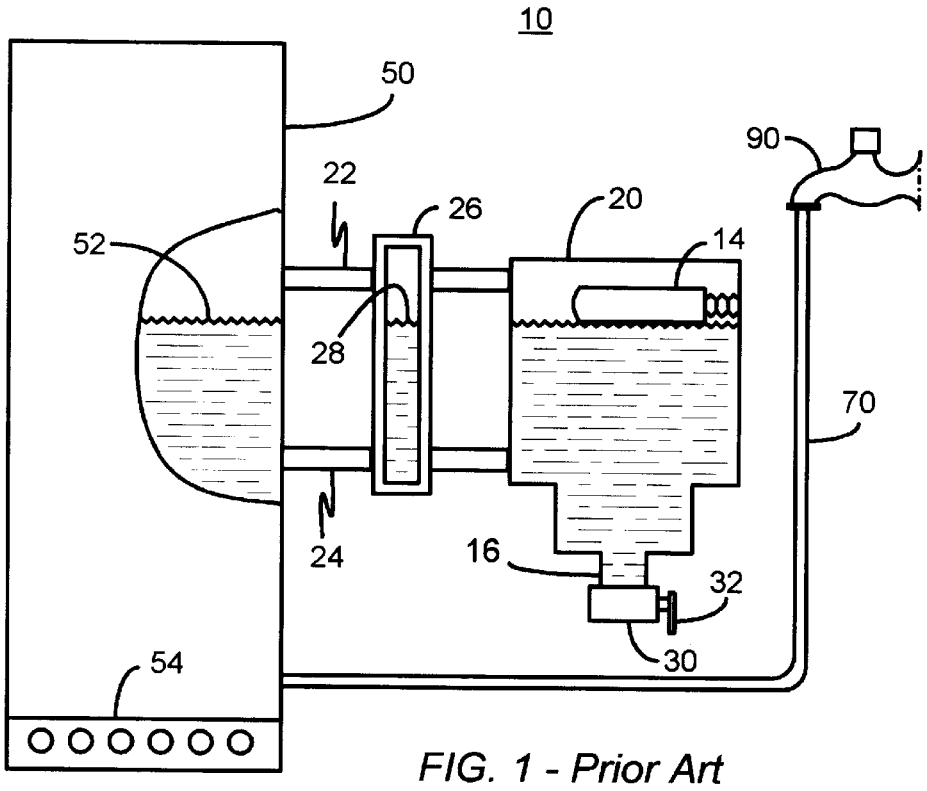
FIG. 1 - Prior Art
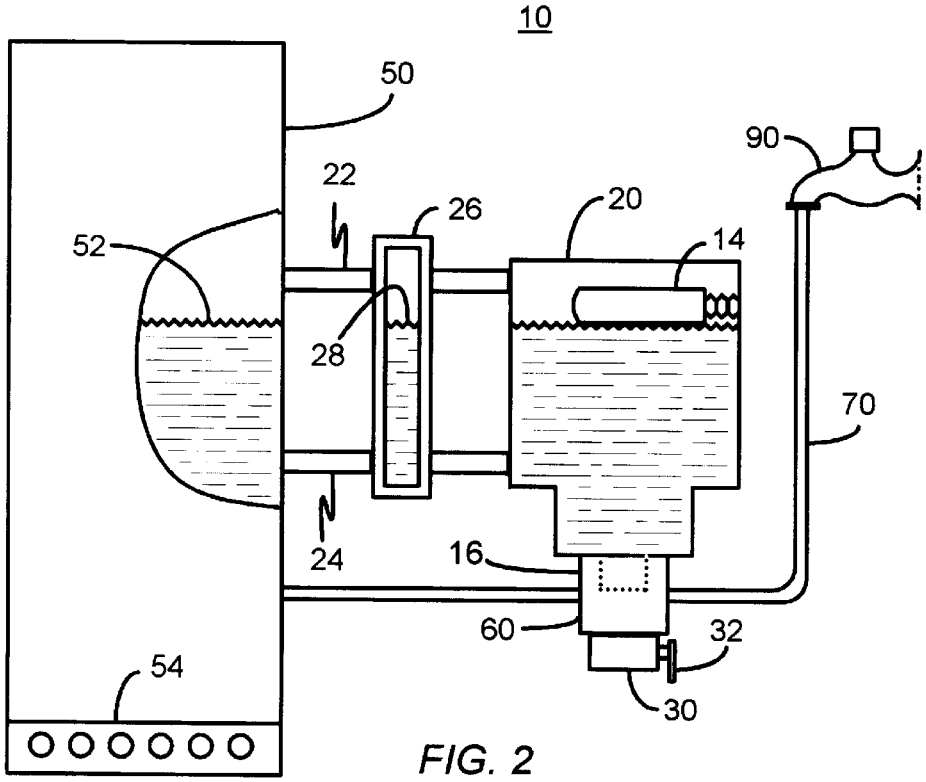
FIG. 2

APPARATUS AND METHOD FOR FLUSHING BOILER LOW-WATER CUTOFF SYSTEMS

BACKGROUND OF THE INVENTION

1. Field of the Invention

This invention relates to steam boiler low-water cutoff systems, which prevent the activation of the boiler's heating elements in unsafe conditions. Particularly this invention relates to a method and apparatus for flushing steam boiler low-water cutoff systems. More particularly this invention relates to in-service flushing of solid particles, scale and debris from the working components of steam boiler low-water cutoff systems. Even more particularly this invention relates to the rerouting of a water make-up line through a flushing unit attached to a steam boiler low-water cutoff system that allows for in-service flushing of solid particles, scale and debris from the working components of the steam boiler low-water cutoff system each time make-up water is added to the steam boiler system.

2. Description of the Related Art

Most steam or hot water boiler heating systems are comprised of a water reservoir, a firing mechanism and means to add water to the system. The firing mechanism, usually a coal, oil or gas burner, heats the water in the water reservoir to produce steam or hot water for heating residential, commercial or industrial buildings. Heating system burners are normally controlled by a solenoid actuated valve, which controls the supply of air to coal fired burners or which controls the flow of fuel to oil or gas type burners.

Over time, as the hot water or steam circulates through the heating system, small amounts of water or steam are lost to the surroundings. Additional water must be added to the heating system to make up for this lost water. This water is replenished into the heating system through a make-up water line. If, however, the water is not properly replenished and the water level in the boiler falls below a safe operating level while the burner continues to operate, serious damage or destruction of the heating system may occur. Therefore, in addition to the heating system components listed above, safety codes require that control devices be installed for disabling the burner when the water level in the heating system falls below a predetermined hazard level. These control devices are known in the art as low-water cutoff systems.

Many low-water cutoff systems are comprised of a sight gauge and an electrical or mechanical float-type water level sensor. The water level sensor monitors the boiler water level. Typically, when the water level sensor detects an inadequate water level for operation it triggers a control switch that adds water to the boiler while simultaneously deactivating the burner until the water level is brought back up to a sufficient level. The sight gauge allows an operator to visually monitor the water level in the heating system and may contain additional means for deactivating the boiler in unsafe conditions.

Typical displacement or float-type water level sensors are attached to a pivotal linkage on the interior of a sensor chamber and are surrounded by a protective sleeve or bellows. The sensor chamber holds an amount of water, which in optimum conditions mirrors the level of water in the boiler. As the water level in the boiler falls so will the water level in the sensor chamber. As the water level in the sensor chamber falls the buoyant force on the float is reduced which causes the float to drop. If the float dips below a certain predetermined level it triggers a cutoff signal, usually a solenoid actuated valve, that will prevent the burner from operating. The float will also trigger a separate valve connected to the water make-up line that will supply additional water to the boiler. One popular example of the mechanical float-type low-water cutoff system is the McDonald Miller No. 67.

Other low-water cutoff systems employ electrical sensors that work in much the same way as the float-type sensors. An electrical sensor is placed on the inside of a water filled sensor chamber below the low water line. The sensor is connected to an electrical circuit such that while the sensor is submerged in water it completes the circuit. As the water in the boiler drops, which causes the water to drop in the sensor chamber, the electric sensor will become exposed, thereby breaking the circuit and triggering a set of switches that deactivates the burner and activates the water feed cycle.

Unfortunately, regardless of the type of sensor used, after extended periods of time many of these types of low-water cutoff systems become defective due to a buildup of rust, scale or debris on the working parts of the sensor. As debris collects in and around the working components of a sensor, it becomes obstructed and, therefore, ineffective at detecting the true boiler water level. If a sensor fails to detect the proper level of water in the boiler the burner will continue to fire, leading to permanent damage of the heating system.

Depending upon the climate, these heating systems may remain dormant throughout the summer, as many households and businesses do not require heat during these months. This dormant period allows sediment and debris to collect that might obstruct or hinder the performance of the float system. To prevent and remove the buildup of rust, scale and debris, most low-water cutoff systems provide a manual flush valve, which allows for manual periodic flushing of the water surrounding the working components of the low-water cutoff system. Most manufacturers will recommend maintenance schedules that require periodic inspection, flushing and testing of these safety control systems. Unfortunately many homeowners, absentee landlords or businesses without full time maintenance personnel rarely perform this much-needed flushing function, causing many hot water boiler heating systems to get ignored until problems arise.

Many recent improvements in the field, for preventing the low-water firing problem, concentrate on the design of special sensing devices. For example, U.S. Pat. No. 5,060,560 (1991, L. VanDeMark) teaches the use of a backup safety probe or sensor that uses relays to interrupt the flow of electrical energy to the heating element. The backup sensor unit is located outside of the main pressure vessel, in a conduit in fluid communication therewith. This device reduces the risk of overheating by the burner, however, it requires an operator skilled in the maintenance of heating systems to manually blow-down the debris from the low-water cutoff system prior to restarting the heating system. This may result in unnecessary extended periods of dormancy of the heating system when it is most needed.

U.S. Pat. No. 5,224,445 (1993, L. Gilbert) teaches the use of an electronic sensor, which deactivates the burner in low-water or dry conditions and prevents reactivation of the burner until the boiler has returned to a safe condition. This device also reduces the risk of damage to the system caused by overheating but also would require manual blow-down of any debris and resetting of the low-water cutoff system prior to the restart of the heating system.

U.S. Pat. No. 4,941,435 (1990, T. Person) teaches the use of an electronically activated blow-down valve. This system utilizes a microprocessor, which signals a solenoid valve, to open or blow-down for a period of between one and twenty seconds, whenever the water feed cycle to the boiler commences. One drawback with this system is that it requires the use of multiple components including a microprocessor, which increases the chance of system failure. Another disadvantage with this system is that it requires an appropriate environment into which rusty or other debris-laden water may be randomly discharged from the heating system.

What is needed is a method and apparatus for in-service flushing of solid particles, scale and debris from the working components of steam boiler low-water cutoff systems.

What is further needed is a method and apparatus for in-service flushing of solid particles, scale and debris from the working components of steam boiler low-water cutoff systems that can be added to newly manufactured low-water cutoff systems.

What is further needed is a method and apparatus for in-service flushing of solid particles, scale and debris from the working components of steam boiler low-water cutoff systems that can be easily annexed to a variety of currently installed low-water cutoff systems, including both electronic and mechanical type sensor systems.

What is further needed is a method and apparatus for in-service flushing of solid particles, scale and debris from the working components of steam boiler low-water cutoff systems that connects to and employs the make-up water line.

What is further needed is a method and apparatus for in-service flushing of solid particles, scale and debris from the working components of steam boiler low-water cutoff systems that is simple in design.

What is further needed is a method and apparatus for in-service flushing of solid particles, scale and debris from the working components of steam boiler low-water cutoff systems that is inexpensive and simple to install.

SUMMARY OF THE INVENTION

It is therefore an object of the present invention to provide an apparatus and method for flushing debris and other foreign particles from the working components of boiler low-water cutoff systems.

It is another object of the present invention to provide an apparatus and method for flushing debris and other foreign particles from the working components of low-water cutoff systems that may be added to newly manufactured low-water cutoff systems.

It is another object of the present invention to provide an apparatus and method for flushing debris and other foreign particles from the working components of low-water cutoff systems that may be easily mounted to a variety of pre-installed low-water cutoff systems.

It is a further object of the present invention to provide an apparatus and method for flushing debris and other foreign particles from the working components of low-water cutoff systems that connects to the make-up water line.

It is even a further object of the present invention to provide an apparatus and method for flushing debris and other foreign particles from the working components of low-water cutoff systems that is simple in design.

It is even a further object of the present invention to provide an apparatus and method for flushing debris and other foreign particles from the working components of low-water cutoff systems that is simple to install.

The present invention solves these and other important objectives. The present invention employs a flushing unit that attaches to either new or currently installed boiler low-water cutoff systems. The flushing unit is attached to the lower end of the low-water cutoff system and to the water make-up line. As the water level in the boiler falls the low-water cutoff system detects the drop and triggers the water make-up line to fill the boiler. As water is added to the boiler it is rerouted through the flushing unit, which is in fluid contact with the low-water cutoff system, creating a transverse flow of water through the flushing unit. The transverse flow of the make-up water through the flushing unit flushes away rust and other debris from the low-water cutoff system into the boiler.

The flushing unit is preferably manufactured from a block of machinable corrosion resistant metallic material. A first conduit is machined through the block from one side to an opposite side to allow make-up water to pass through the block. A second conduit, which passes through the first conduit, is machined between the top and bottom surfaces. When the flushing unit is attached to a low-water cutoff system the opening in the top surface, which may be adjusted to accommodate different size low-water cutoff systems, allows water in the low-water cutoff system to communicate with make-up water passing through the flushing unit. Whenever water is added to the boiler through the make-up water line, rust and other debris is removed from the low-water cutoff system and flushed into the boiler, thereby improving the efficiency and longevity of the low-water cutoff system.

To install the flushing unit the manual blowdown unit is first removed from the low-water cutoff system if it has already been installed. The flushing unit is then attached, preferably by a series of bolts or other similar fasteners, to the low-water cutoff system in place of the manual blowdown unit. The make-up water line is then rerouted into the flushing unit. The flushing unit is then either connected directly to the boiler or an outlet line is run from the flushing unit into the boiler. The manual blowdown unit is then reattached to the bottom of the flushing unit. When the manual blowdown unit is activated it flushes rust and other debris out of the low-water cutoff system, through the flushing unit and out of the boiler system.

The present invention is primarily described and related to steam boiler systems, which employ mechanical float-type low-water sensor systems, however, it may be adapted to other systems, such as the above-mentioned electronic type low-water sensor systems. The present invention may also be employed in other types of industry, including for example the chemical process industry, which has similar liquid level sensors that would benefit from periodic in-service flushing.

BRIEF DESCRIPTION OF THE DRAWINGS

FIG. 1 is a schematic drawing showing a prior art low-water cutoff system and a make-up water line independently attached to a boiler.

FIG. 2 is a schematic drawing showing a low-water cutoff system attached to a boiler, a flow through flushing unit attached to the low-water cut-off system and a make-up water line passing through the flushing unit.

DETAILED DESCRIPTION OF THE PREFERRED EMBODIMENT

Figure 3:
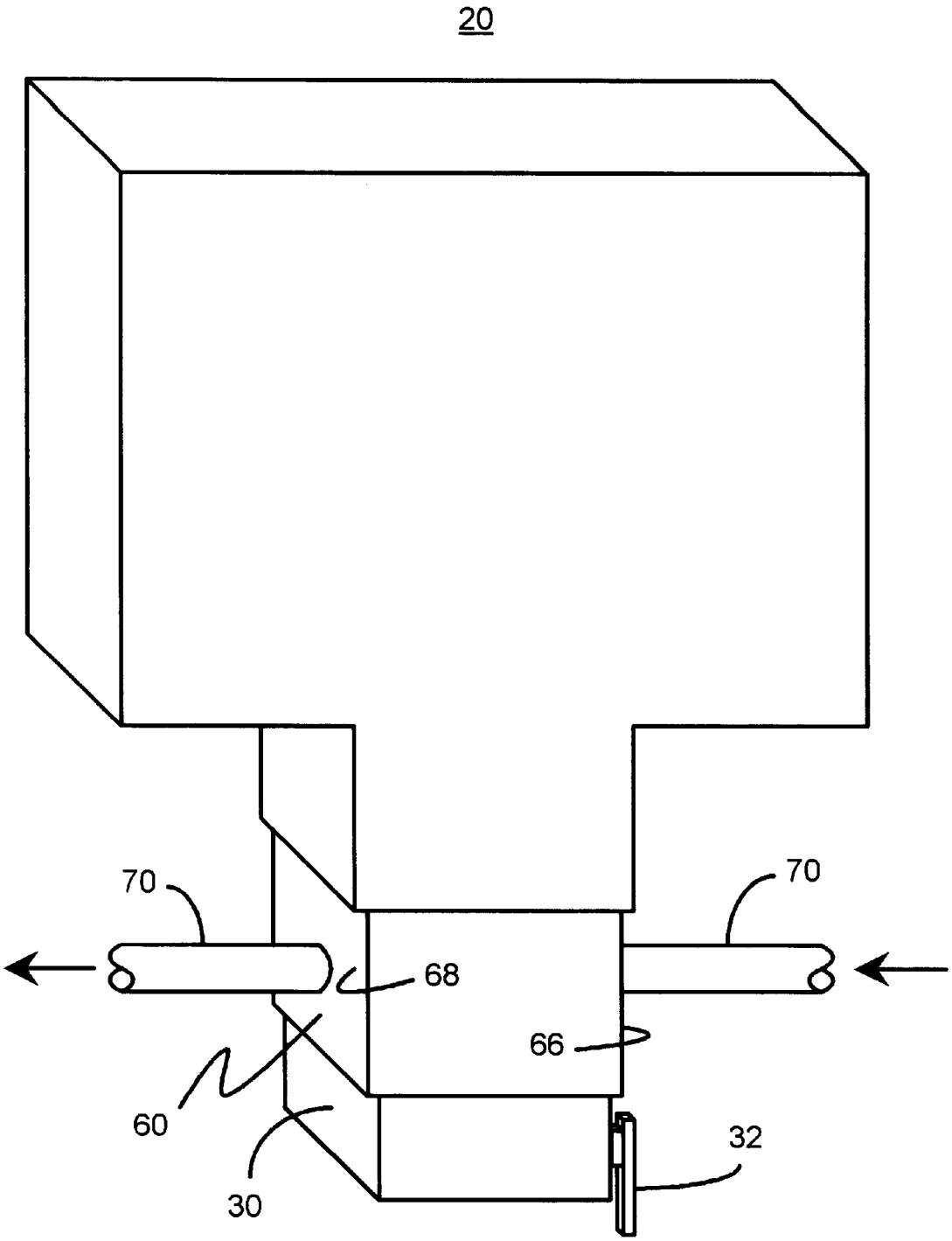
FIG. 3 is an enlarged view of the flow through flushing unit attached to a low-water cut-off system, with a make-up water line passing through the flushing unit as shown in FIG. 2.

For the purposes of promoting an understanding of the principles of the invention, reference will now be made to the preferred embodiment of the present invention as illustrated in FIGS. 1–8, and specific language used to describe the same. It will nevertheless be understood that no limitation of the scope of the invention is thereby intended. Any modifications or variations in the depicted method or device, and such further applications of the principles of the invention as illustrated therein being contemplated as would normally occur to one skilled in the art to which the invention relates, are deemed to be within the spirit of the present invention.

Referring now to FIG. 1, there is shown a conventional steam boiler heating system 10 having a boiler 50. Water is introduced into boiler 50 by water source 90 through make-up water line 70. A burner 54 is used to heat the water in boiler 50 to create steam or hot water, which is then utilized by the heating system 10.

A low-water cutoff system 20 is shown attached to boiler 50 via a set of two flow-through conduits 22 and 24. Low-water cutoff system 20 deactivates boiler 50 when the water level 52 in boiler 50 drops below a predetermined level. Low-water cutoff system 20, in addition to deactivating boiler 50 when the water level 52 is too low, is also used to initiate make-up water line 70 to add more water to boiler 50.

A sight glass 26 is positioned along flow-through conduits 22 and 24, between the low-water cutoff system 20 and the boiler 50. Sight glass 26 provides visual reference of a column of water 28, which reflects the water level 52 in boiler 50. Flow-through conduits 22 and 24 maintain the water levels in the sight glass 26 and in the low-water cutoff system 20.

Low-water cutoff system 20 is shown equipped with a float sensor 14. Float sensor 14 is hingedly attached to the inside of low-water cutoff system 20 such that it floats on top of the water in low-water cutoff system 20. As the water level 52 diminishes in boiler 50 the water level in the low-water cutoff system 20 will also fall, thereby causing float sensor 14 to descend. Optimally, when the float sensor 14 pitches down below a predetermined low-water safety level, it triggers a fuel control switch (not shown), which temporarily shuts off burner 54. In addition to shutting off burner 54, float sensor 14 also triggers a water make-up switch (not shown), which adds make-up water to boiler 50, via water make-up line 70.

What occurs, unfortunately, is that over time rust, scale and other debris tend to collect in low-water cutoff system 20. As this happens float sensor 14 often becomes obstructed to a point of inoperability. This means that even if the water level in low-water cutoff system 20 falls, an accompanying drop in float sensor 14 may not occur, thereby allowing the burner 54 to remain operating in an unsafe condition. Prolonged operation of burner 54 without sufficient water in boiler 50 will damage heating system 20.

To prevent float sensor 14 from becoming obstructed, a manually operated flushing device 30, shown attached to the lower end 16 of low-water cutoff system 20, is used to flush rust and other debris from the low-water cutoff system 20. By activating flushing device 30, water containing rust and other debris may be purged from low-water cutoff system 20. This flushing must be performed on a regularly basis. All too often, however, these systems are left unattended until a problem occurs.

Referring now to FIG. 2, manually operated flushing device 30 is shown removed from lower end 16 of low-water cutoff system 20. A flushing unit 60 is shown attached to the lower end 16 of low-water cutoff system 20 in the location previously occupied by manually operated flushing device 30. The manually operated flushing device 30 is shown attached to the bottom of flushing unit 60. Make-up water line 70 is shown rerouted through flushing unit 60, which is in fluid connection with low-water cutoff system 20. By rerouting make-up water line 70 through flushing unit 60, each time make-up water is added to boiler 50, rust and other debris is flushed from low-water cutoff system 20, through flushing unit 60 and harmlessly into boiler 50. Thereby, preventing an accumulation of rust and other debris in low-water cutoff system 20.

Referring now to FIG. 3, an enlarged view of the configuration of flushing unit 60, low-water cut-off system 20, make-up water line 70 and manually operated flushing device 30 is shown. As rust, scale and other debris accumulate over time it will settle in the bottom of the low-water cut-off system 20. Make-up water enters flushing unit 60 through make-up water line 70. As the make-up water flows through flushing unit 60 it creates a transverse flow that will carry the debris accumulated in the bottom of the low-water cutoff system out through make-up water line 70 and into boiler 50.

Figure 4:
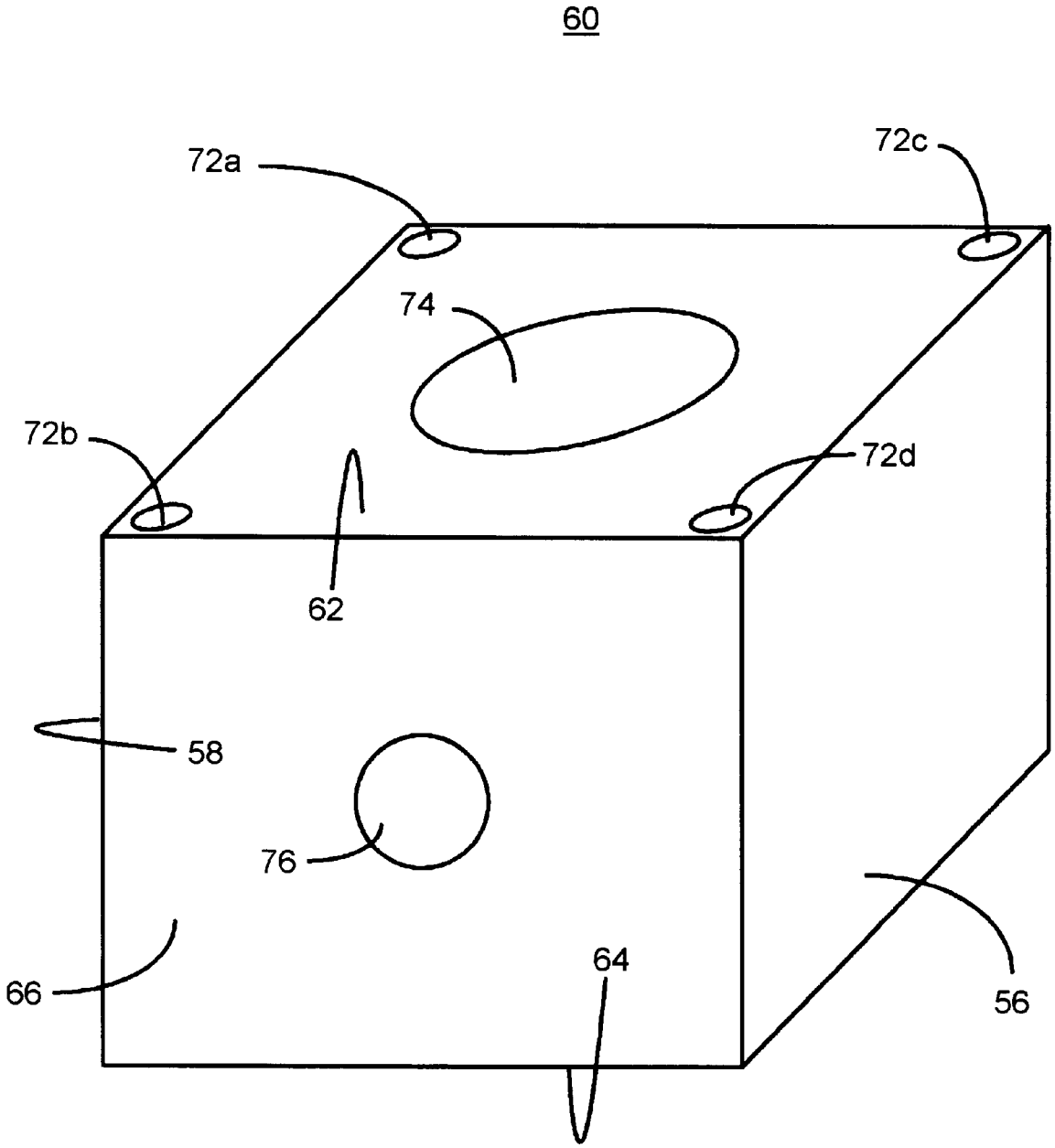
FIG. 4 is a perspective view of the flushing unit.

Referring now to FIG. 4, a perspective view of the flushing unit 60 is shown. Flushing unit 60 has a top aperture 74 in upper end 62 for receiving the low-water cutoff system 20. A first side aperture 76 is shown in first end 66 for receiving make-up water line 70. A second side aperture 78 (not shown), which operates as an outlet for make-up water line 70, occurs in second end 68. A series of hollow shafts 72*a*, 72*b*, 72*c*, and 72*d* penetrate through flushing unit 60 and are provided for bolting or otherwise fastening flushing unit 60 to low-water cutoff system 20. The quantity and spacing of shafts 72*a*–72*d* may be varied to accommodate different brands or types of low-water cutoff systems. Likewise, other methods of securing flushing unit 60 to low-water cutoff system 20 may be used. For example, top aperture 74 may be threaded to securely attach flushing unit 60 to a similarly threaded low-water cutoff system.

Flushing unit 60 is relatively inexpensive and easy to make. Flushing unit 60 may be made using a variety of processes including machining, casting or molding. A variety of materials may be used to fabricate flushing unit 60 such as metal alloys, ceramics, polymers or composites. The present description of the shape of flushing unit 60 is not critical to its operation. Flushing unit 60 may be made in a variety of different configurations that allow fluid to pass through flushing unit 60 while flushing out low-water cutoff system 20.

To fabricate flushing unit 60 by machining, a block of material is obtained that is of sufficient size to allow for an aperture 74, which is large enough to accommodate low-water cutoff system 20. A conduit 80 is drilled through the block of material thereby creating side apertures 76 and 78. Top aperture 74 is then machined partially through the top of the block of material. A conduit 86 is then drilled through the middle of aperture 74 into conduit 80 creating an aperture 82 in conduit 80. Hollow shafts 72*a*, 72*b*, 72*c*, and 72*d* are then drilled though the block of material.

Figure 5:
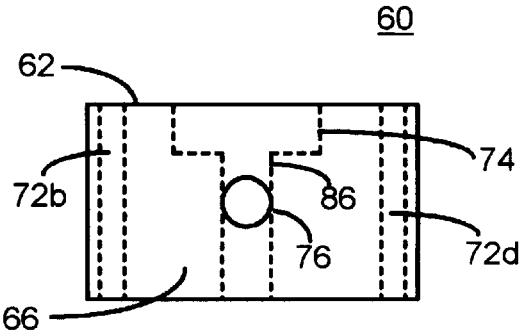
FIG. 5 is a first end view of the flushing unit.

Referring now to FIG. 5, an end view of flushing unit 60 is shown, showing first end 66, top aperture 74, first side aperture 76, and conduit 86. Also shown is upper end 62 and hollow shafts 72*b* and 72*d*.

Figure 6:
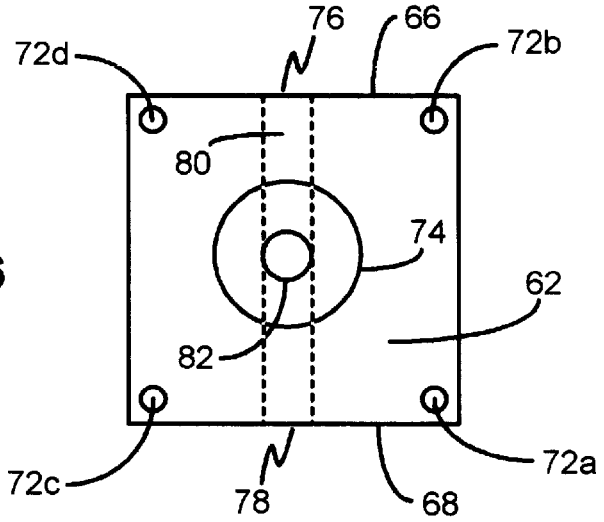
FIG. 6 is a top view of the flushing unit.

Referring now to FIG. 6, a top view of flushing unit 60 is shown, showing upper end 62. Conduit 80, which runs from first side aperture 76 in first end 66 to second side aperture 78 in second end 68, is shown. Conduit aperture 82, shown in conduit 80, allows rust 30 and other debris to pass from low-water cutoff system 20 through first top aperture 74, down into conduit 80, and eventually out of flushing unit 60 via second side aperture 78.

Figure 7:
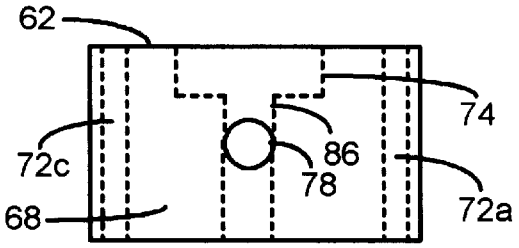
FIG. 7 is a second end view of the flushing unit.

Referring now to FIG. 7, an end view of flushing unit 60 is shown, showing second end 68, top aperture 74, second side aperture 78, and conduit 86. Also shown is upper end 62 and hollow shafts 72*c* and 72*a*.

Figure 8:
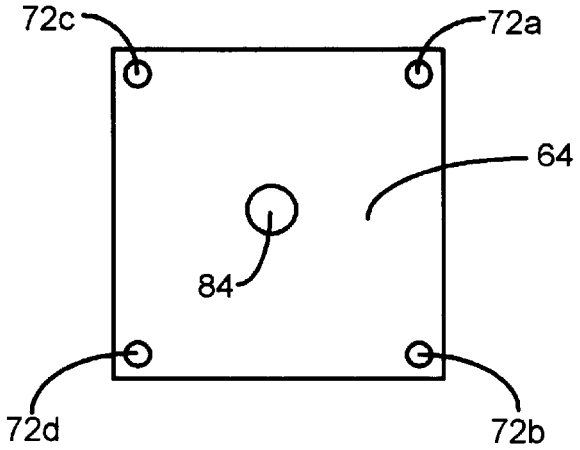
FIG. 8 is a bottom view of the flushing unit.

Referring now to FIG. 8, a bottom view of flushing unit 60 is shown, showing lower end 64. A bottom aperture 84 is shown in lower end 64. A conduit, not shown, runs from bottom aperture 84 to an opening in conduit 80. When flushing unit 60 is attached to low-water cutoff system 20, and manually operated flushing device 30 is attached to lower end 64 of flushing unit 60, the conduit running from conduit 80 to lower end 64 allows rust and other debris to pass from low-water cutoff system 20 through flushing unit 60 to be manually flushed from low-water cutoff system 20 via manually operated flushing device 30.

What is claimed is:

1. A low-fluid level cutoff system flushing unit for flushing boiler low-water cutoff systems comprising:

a first conduit having at least a low-fluid level cutoff system aperture for communicating with a first fluid in a low-fluid level cutoff system of a boiler; and a second conduit intersecting said first conduit, said second conduit having a fluid inlet aperture for receiving a second fluid from a fluid source and a fluid outlet aperture for discharging said second fluid into said boiler whereby said second fluid flows through said second conduit and draws said first fluid from said low-fluid level cutoff system and out through said fluid outlet aperture with said second fluid.

2. The flushing unit as claimed in claim 1 wherein said flushing unit is removably connected to said low-fluid level cutoff system.

3. The flushing unit as claimed in claim 1 wherein said first conduit further includes a low-fluid level cutoff system drain aperture located beyond the point of intersection of said first conduit and said second conduit.

4. The flushing unit as claimed in claim 3 wherein a drain valve is operatively connected to said low-fluid level cutoff system drain aperture.

5. The flushing unit as claimed in claim 1 wherein said flushing unit is fixedly connected to said low-fluid level cutoff system.

6. The flushing unit as claimed in claim 1 wherein said flushing unit is made of a metallic material.

7. The flushing unit as claimed in claim 1 wherein said flushing unit is made of a composite material.

8. The flushing unit as claimed in claim 1 wherein said flushing unit is made of a ceramic material.

9. The flushing unit as claimed in claim 1 wherein said flushing unit is made of a polymer material.

10. A method of making a low-fluid level cutoff system flushing unit for a boiler comprising:

a. combining a first conduit and a second conduit wherein said first conduit and said second conduit intersect;

b. adapting said first conduit to have at least a low-fluid level aperture for communicating with a first fluid in a low-fluid level cutoff system of said boiler; and c. adapting one end of said second conduit to have a fluid inlet aperture for receiving a second fluid from a fluid source and adapting an opposite end of said second conduit to have a fluid outlet aperture for discharging said first fluid and said second fluid into said boiler.

11. The method as claimed in claim 10 further comprising adapting said first conduit to have a discharge aperture for connecting to a drain valve located beyond the point of intersection of said first conduit and said second conduit.

12. A method of using a low-fluid level cutoff system flushing unit comprising:

a. mounting a low-fluid level cutoff system flushing unit to a low-fluid level cutoff system of a boiler, said flushing unit having a first conduit with at least a low-fluid level cutoff system aperture for communicating with a first fluid in said low-fluid level cutoff system and a second conduit intersecting said first conduit, said second conduit having a fluid inlet aperture for communicating with a second fluid from a fluid source and a fluid outlet aperture for communicating with a boiler fluid reservoir, said fluid reservoir being in fluid communication with said low-fluid level cutoff system;

b. attaching said fluid source to said fluid inlet aperture of said second conduit;

c. attaching said fluid outlet aperture of said second conduit to said fluid reservoir;

d. sensing when a fluid level in said fluid reservoir falls below a certain predetermined level;

e. activating said fluid source to release said second fluid;

f. introducing said second fluid into said flushing unit so that said second fluid draws said first fluid from said low-fluid level cutoff system;

g. discharging said first fluid and said second fluid through said fluid outlet aperture into said fluid reservoir;

h. sensing when said fluid level in said fluid reservoir exceeds a certain predetermined level; and l. deactivating said fluid source.

13. The method as claimed in claim 12 wherein said fluid source is a water make-up line.

14. The method as claimed in claim 12 further comprising attaching a discharge conduit between said fluid outlet aperture and said fluid reservoir.

15. The method as claimed in claim 13 wherein said discharge conduit is connected to a boiler.

16. The method as claimed in claim 12 further including attaching a drain valve to said flushing unit such that said drain valve is in fluid communication with said first fluid and said second fluid in said flushing unit.

* * * * *